US010640910B2

(12) United States Patent
Allen et al.

(10) Patent No.: US 10,640,910 B2
(45) Date of Patent: May 5, 2020

(54) HIGH-SPEED DRYING UNIT FOR LOCKER

(71) Applicants: Sam Allen, Maypearl, TX (US); John Allen, Desoto, TX (US)

(72) Inventors: Sam Allen, Maypearl, TX (US); John Allen, Desoto, TX (US)

( * ) Notice: Subject to any disclaimer, the term of this patent is extended or adjusted under 35 U.S.C. 154(b) by 0 days.

(21) Appl. No.: 16/429,895

(22) Filed: Jun. 3, 2019

(65) Prior Publication Data

US 2019/0284748 A1 Sep. 19, 2019

(51) Int. Cl.

| | |
|---|---|
| ***F26B 25/06*** | (2006.01) |
| ***D06F 57/12*** | (2006.01) |
| ***F26B 21/00*** | (2006.01) |
| ***A47B 97/00*** | (2006.01) |
| ***G07F 17/12*** | (2006.01) |

(52) U.S. Cl.

CPC ..... *D06F 57/122* (2013.01); *A47B 97/00* (2013.01); *F26B 21/001* (2013.01); *G07F 17/12* (2013.01)

(58) Field of Classification Search

CPC ..... D06F 58/203; D06F 58/10; D06F 57/122; F26B 9/06; F26B 21/001; F26B 21/004; F26B 3/04; F26B 9/003; G07F 17/12; G07F 9/105; A47B 97/00

USPC ..... 34/235, 210, 201, 202, 209, 212

See application file for complete search history.

(56) References Cited

U.S. PATENT DOCUMENTS

| | | | | |
|---|---|---|---|---|
| 4,959,911 | A * | 10/1990 | Wolens | D06F 58/14 211/195 |
| 5,369,892 | A | 12/1994 | Dhaemers | |
| 8,756,827 | B1 * | 6/2014 | Calabro | B05B 16/60 34/487 |
| 9,127,395 | B2 * | 9/2015 | Kim | D06F 39/125 |
| 9,845,561 | B2 * | 12/2017 | Doyle | D06F 29/00 |
| 2004/0226320 | A1 * | 11/2004 | Bongini | D06F 39/12 68/3 R |
| 2007/0193058 | A1 * | 8/2007 | Zarembinski | D06F 58/10 34/202 |
| 2008/0256826 | A1 * | 10/2008 | Zarembinski | D06F 58/10 34/562 |
| 2018/0094855 | A1 * | 4/2018 | Allen | F26B 21/006 |
| 2020/0010007 | A1 * | 1/2020 | Sanders | B60P 3/00 |

* cited by examiner

*Primary Examiner* — John P McCormack
(74) *Attorney, Agent, or Firm* — James E. Walton

(57) ABSTRACT

A locker includes a pair of spaced-apart upstanding sidewalls and at least one compartment defined between the upstanding sidewalls. A drying compartment includes an upper and lower horizontal panels, at least one of the upper and lower panels being hollow and extending at least partially between the sidewalls of the locker. A pair of compartment sidewalls are connected to the panels, at least one of the compartment sidewalls being in fluid communication with the at least one hollow upper and lower panels. A perforated rear panel is connected to the compartment sidewalls and the upper and lower panels and is in fluid communication with an interior of the drying compartment. At least one fan is disposed in one of the compartment sidewalls, wherein the fan draws air from the at least one hollow upper and lower panels, directs it into the interior of the drying compartment, and the air is exhausted from the compartment though the perforated rear panel.

16 Claims, 2 Drawing Sheets

HIGH-SPEED DRYING UNIT FOR LOCKER

BACKGROUND

1. Field of the Invention

The present invention relates generally to improvements in lockers or storage cabinets used in athletic or sporting facilities, and more specifically to compartments of such lockers for storing wet equipment.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers, including the ability to store athletic or sporting equipment in ways that prolong their useful life.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
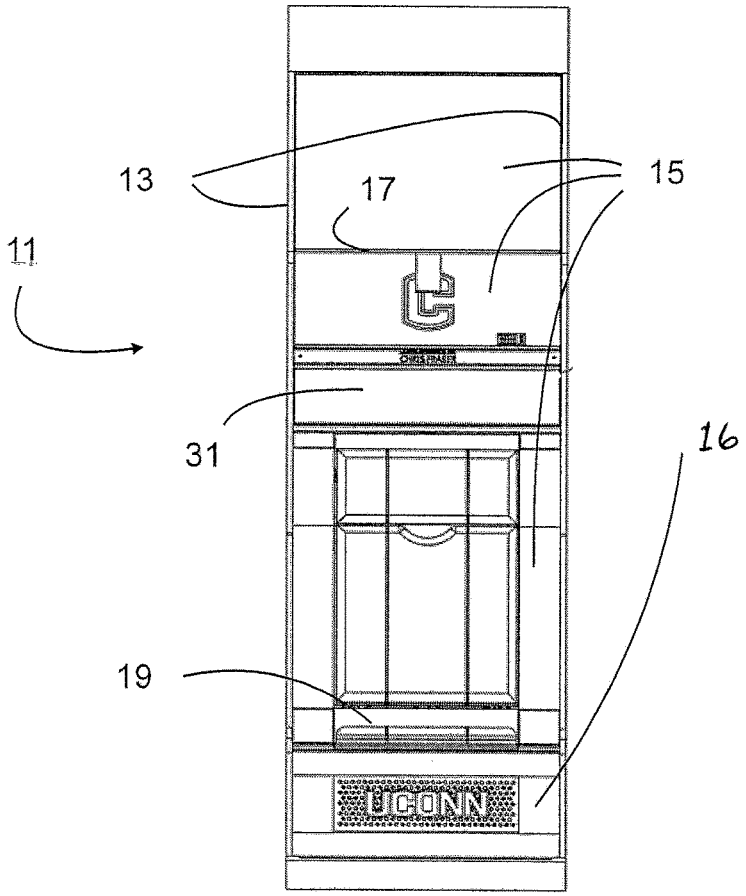
FIG. 1 is an elevation view of a locker having a high-speed drying unit according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker and high-speed drying unit of the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and timeconsuming, but would nevertheless be a routine undertaking for those of ordinary skill in the art having the benefit of this disclosure.

Referring now to FIG. 1 in the drawings, a locker 11 according to the present application is illustrated. As can be seen, locker 11 comprises a pair of upstanding sidewalls 13 that generally define the extent of locker 11. Sidewalls 13 may be connected at the rear by a rear wall, at the top by a top wall, and at the bottom by a bottom wall. it will be appreciated that the rear wall, the top wall, and the bottom wall may be formed of multiple components parts, each of which may perform additional functions other than merely forming an enclosure, such as ventilation plenums, interconnecting surfaces, ventilation conduits, electrical conduits, etc. Each locker may be installed adjacent to another, similar or identical locker, with its rear against a wall, and its front facing the interior of the locker room.

Between sidewalls 13 of locker 11, a plurality of compartments 15 are defined by dividers 17 that may include vertical panels parallel to sidewalls 13, or shelves or other horizontally extending surfaces, panels, or platforms that serve to connect sidewalls 13 and lend rigidity and strength to locker 11, in addition to forming compartments 15. Each compartment 15 may be sized and otherwise configured for storage of clothing, sporting equipment, or other items, and may include doors, ventilation grills, sliding components, tilting components, equipment racks, and equipment holders, any of which may be lockable. Locker 11 may also include a generally horizontal seat 19, which sits atop a "footlocker" or lowermost footlocker compartment 16, which may be forward of the remainder of locker 11, and which may form a door to the footlocker compartment 16.

Figure 2A:
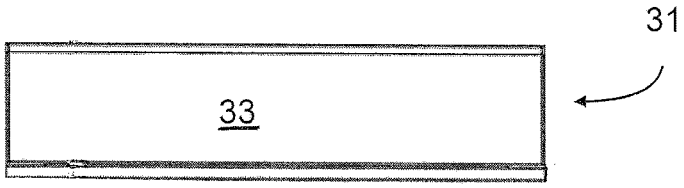
FIGS. 2A and 2B are enlarged elevation views of a drying unit of the locker of FIG. 1, with the door closed and opened, respectively.
Figure 2B:
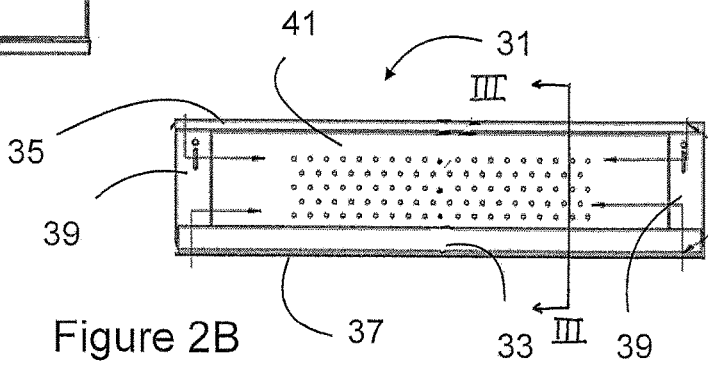
Figure 3:
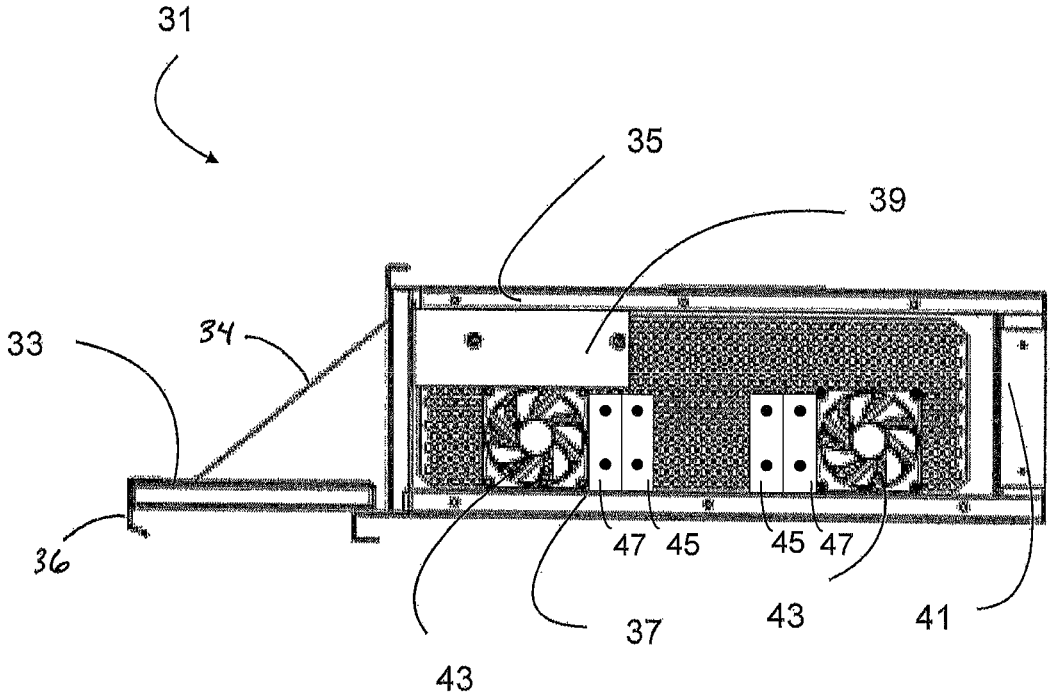
FIG. 3 is a side section view, taken along section line III-III of FIG. 2B.

Referring now also to FIGS. 2A, 2B, and 3 in the drawings, included among the various compartments 15 of locker 11 may be a high-speed drying unit 31. According to a preferred embodiment of the present application, drying unit 31 may be a full- or partial-width, rectangular, or otherwise configured, compartment adapted particularly for the storage and high-speed drying of wet equipment and/or clothing. Drying unit 31 may be integrally installed into locker 11, or may be installed as a stand-alone unit that can be quickly and easily removed and replaced for servicing, maintenance, or interchangeability. Drying unit 31 is preferably provided with a door 33 that may be accessed from the front of locker 11, and that is hinged at a lower extent, so that, in the open position (FIGS. 2B and 3), the full width and height of drying unit 31 is opened and accessible. A handle 36 may be provided at the upper extent, or other convenient location, of door 33 and preferably is of bent stainless steel or aluminum, but may be of any configuration. A door support mechanism, such as one or more cables 34, may be provided and coupled to door 33 to prevent overtravel and support. Door support mechanism 34 may include counterweight features to assist with opening and closing door 33, and may include pneumatic cylinders or other components to provide a soft-close element to drying unit 31.

Upper 35 and lower 37 shelves or horizontal dividers are preferably formed of corrosion-resistant metallic or polymer material (preferably stainless steel) and are hollow and open at least the forward or front ends and serve as air intakes. Shelves 35 and 37 extend at least partially between sidewalls 13 and are in fluid communication with right and left compartment sidewalls 39, which may be formed of at least partially perforated metallic or polymer material, again preferably stainless steel, and may be hollow structures. Compartment sidewalls 39 are just interior of locker sidewalls 13 and extend between and connect shelves 35 and 37. In a similar fashion, a rear wall 41 may be at least partially perforated and formed or metallic or polymeric material to resist corrosion.

As shown in FIG. 3, at least one, and preferably two, high-speed ventilation fans 43 may be provided in each (right and left) sidewall 39. Fans 43 preferably may be Delta AFB812EHE (available from Delta Electronics (Americas) Ltd., 46101 Fremont Blvd., Fremont, Calif. 94538) 80 mm fans rated at about 80 cubic feet per minute capacity and are configured to direct forced air to the interior of drying unit 31. Other fan sizes and capacities may be desired depending upon the volume, size, and shape of drying unit 31, depending upon the amount of time desired to dry the clothes and/or equipment placed in drying unit 31, and/or depending upon other factors, such as the particular equipment to be dried, ambient conditions, etc. It will be appreciated that this unique high-speed drying system has a significantly higher capacity than conventional ventilation systems in lockers.

The unique functionality and capacity of drying unit 31 is best understood by an actual example performed with a working prototype of drying unit 31. In the example, a pair of adult cleats were filled with water and the water was allowed to soak in for two minutes. After two minutes, the remaining water was poured out of the cleats. In addition, a pair of knee braces were dunked under water for several seconds and then removed from the water. Then, the water-soaked cleats and the water-soaked knee braces were placed in drying unit 31. Drying unit 31 was turned on and the cleats and the knee braces were dry in about seventy-five minutes. This example was performed without the use of the optional heating elements described below.

Locker 11 may include a forced-air ventilation system, and the forced-air ventilation system may be connected to an HVAC system for the locker room, so that the "dirty" air being circulated throughout locker 11 may be vented and/or filtered outside of the locker room. Drying unit 31 may be separate from such forced-air ventilation system contain in locker 11, or may be integrated with such forced-air ventilation system of locker 11. Indeed, it may be desirable to exhaust the air from drying unit 31 to an external location to assist in eliminating any odor contained within drying unit 31 and/or the items being dried. Thus, drying unit 31 may include conduits and adapters for attachment to the forced-air ventilation system and/or the HVAC system.

Drying unit 31 may include one or more heating elements 45 to assist in the high-speed drying of the clothing and/or equipment placed in drying unit 31. The heating elements 45 selectively heat the air that is circulated by fans 43, thereby accelerating the time required to dry the equipment and/or clothing. In addition, drying unit 31 may include one or more chemical dispensing units 47 for selectively dispensing chemicals, such as detergents, deodorants, anti-bacterial chemicals, anti-static substances, etc. during the operation of drying unit 31. The heating elements 45 and the chemical dispensing units 47 are preferably disposed within void spaces in upper and lower shelves 35 and 37, side walls 39, and/or rear wall 41 of drying unit 31. It will be appreciated that the fans 43, the heating elements 45, and/or the chemical dispensing units 47 may be controlled by a specialized microprocessor-controlled computerized control system and/or computer network that may be selectively programmed to control the operational parameters and maintenance of drying unit 31. In this manner, multiple drying units 31 over multiple lockers 11 may be networked together to perform the efficient operation of drying units 31. It will be appreciated that the heating elements 45 may be in communication with a centralized source of heat, such as a main gas or electric heater, boiler, or other heat source, where the heat is distributed to the individual lockers 11. Similarly, the chemical dispensing units 47 may be in communication with a centralized source of chemicals, such as tank or reservoir, where the chemicals are distributed to the individual lockers.

In operation, wet clothing and/or equipment may be inserted into drying unit 31. Fans 43 may be energized or turned on by a manual switch or automatically via the control system. The control system may include an optical or other type of sensor that detects the presence of items in drying unit 31 and energizes fans 43 only while items are present and require drying. Fans 43 may alternatively run "full-time" or on a timer on a specific, predetermined schedule, for example, at night, or for two hours after events or practices are scheduled to end.

Fans 43, when energized, draw air from the exterior of locker 11 through hollow shelves or panels 35 and 37, into sidewalls 39, and into the interior of compartment 31. Shelves or panels 35 and 37 and compartment sidewalls 39 act as intakes and ducts for the air moved by fans 43. The circulating, forced air assists in drying the items in compartment 31. Air may be exhausted through perforated rear panel 41, either to the atmosphere external to locker 11, or to the plenum of a forced-air ventilation system as described in commonly invented U.S. application Ser. No. 15/897,875, filed Feb. 15, 2018, and Ser. No. 15/823,073, filed Dec. 5, 2017, which are incorporated herein by reference for all purposes. The heating elements and/or the chemical dispensers may be selectively utilized during the drying process.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

We claim:

1. A drying unit for a locker, comprising:

upper and lower horizontal panels;

a pair of drying unit sidewalls extending between the upper and lower horizontal panels;

a rear panel extending between the pair of drying unit sidewalls and between the upper and lower horizontal panels;

a front hinged door disposed between the pair of drying unit sidewalls and between the upper and lower horizontal panels;

at least one fan disposed in at least one of the upper and lower horizontal panels, the pair of drying unit sidewalls, the rear panel, or the door; and wherein the upper and lower horizontal panels, the pair of drying unit sidewalls, the rear panel, and the door define an interior portion of the drying unit;

wherein at least one of the upper and lower horizontal panels, the pair of drying unit sidewalls, the rear panel, and the door are hollow and are at least partially perforated, so as to be in fluid communication with the interior portion;

wherein the fan is configured to direct air into and out of the interior portion; and wherein the drying unit is a separate stand-alone unit that may be removed from and reinstalled into the locker.

2. The drying unit according to claim 1, wherein the upper and lower horizontal panels are hollow, are in fluid communication with the fan, and serve as air intakes.

3. The drying unit according to claim 1, wherein two fans are disposed in each of the pair of drying unit sidewalls.

4. The drying unit according to claim 1, wherein the rear panel is at least partially perforated and the air is exhausted through the perforated rear panel to an exterior of the drying unit.

5. The drying unit according to claim 1, further comprising:

a conduit system for coupling the drying unit to a forced-air ventilation system.

6. The drying unit according to claim 5, wherein the forced-air ventilation system is in fluid communication with a HVAC system in a locker room.

7. The drying unit according to claim 1, further comprising:

a control system for selectively controlling operational parameters of the drying unit.

8. The drying unit according to claim 1, further comprising:

a cable attached to the door to prevent over-travel and to provide support; and a handle attached to the door.

9. A locker, comprising:

a pair of spaced-apart upstanding sidewalls;

at least one compartment defined between the upstanding sidewalls; and a drying unit disposed within the compartment, the drying unit comprising:

upper and lower horizontal panels;

a pair of drying unit sidewalls extending between the upper and lower horizontal panels;

a rear panel extending between the pair of drying unit sidewalls and between the upper and lower horizontal panels;

a front hinged door disposed between the pair of drying unit sidewalls and between the upper and lower horizontal panels; and at least one fan disposed in at least one of the upper and lower horizontal panels, the pair of drying unit sidewalls, the rear panel, or the door;

wherein the upper and lower horizontal panels, the pair of drying unit sidewalls, the rear panel, and the door define an interior portion of the drying unit;

wherein at least one of the upper and lower horizontal panels, the pair of drying unit sidewalls, the rear panel, and the door are hollow and are at least partially perforated, so as to be in fluid communication with the interior portion; and wherein the fan is configured to direct air into and out of the interior portion; and wherein the drying unit is a separate stand-alone unit that may be removed from and reinstalled into the locker.

10. The locker according to claim 9, wherein the upper and lower horizontal panels are hollow, are in fluid communication with the fan, and serve as air intakes.

11. The locker according to claim 9, wherein two fans are disposed in each of the pair of drying unit sidewalls.

12. The locker according to claim 9, wherein the rear panel is at least partially perforated and the air is exhausted through the perforated rear panel to an exterior of the drying unit.

13. The locker according to claim 9, further comprising:

a forced-air ventilation system;

wherein the drying unit is in fluid communication with the forced-air ventilation system.

14. The locker according to claim 13, wherein the forced-air ventilation system is in fluid communication with a HVAC system in a locker room.

15. The locker according to claim 9, further comprising:

a control system for selectively controlling operational parameters the drying unit.

16. The locker according to claim 9, further comprising:

a cable attached to the door to prevent over-travel and to provide support.

* * * * *